United States Patent [19]

Del Fabro

[11] 3,991,600

[45] Nov. 16, 1976

[54] STIRRUP MACHINE

[76] Inventor: Remigio Del Fabro, Villaggio Morena n. 62, Reana Del Roiale, Udine, Italy, 33010

[22] Filed: July 18, 1975

[21] Appl. No.: 597,372

[30] Foreign Application Priority Data

Nov. 15, 1974 Italy ..... 83429/74

[52] U.S. Cl. ..... 72/203; 72/217

[51] Int. Cl.[2] ..... B21D 7/08

[58] Field of Search ..... 72/217, 219, 166, 294, 72/380, 216, 203

[56] References Cited

UNITED STATES PATENTS

| | | | |
|---|---|---|---|
| 3,286,500 | 11/1966 | Weiss | 72/217 X |
| 3,680,347 | 8/1972 | Schenck et al. | 72/217 |
| 3,894,422 | 7/1975 | Peddinghaus | 72/217 |

FOREIGN PATENTS OR APPLICATIONS

| | | | |
|---|---|---|---|
| 1,243,952 | 7/1967 | Germany | 72/217 |

*Primary Examiner*—Milton S. Mehr

*Attorney, Agent, or Firm*—Browdy and Neimark

[57] ABSTRACT

A method and apparatus for bending bars, wires, metal strips or the like has been developed. The apparatus consists of a feeding device which feeds the material to be formed to a central fork pin which holds the material. A rotating disc is provided with a nib for bending the material. After the material is bent, the feed of the material is reversed so as to ensure that the material will be sheared close to the bend, thereby reducing waste.

5 Claims, 25 Drawing Figures

FIG. 2/a

STIRRUP MACHINE

FIELD OF THE INVENTION

This invention is related to a stirrup machine or a bending machine for bars, wire, metal strips, or the like.

BACKGROUND OF THE INVENTION

Semi-automatic or automatic stirrup machines or bending machines which work by means of continuous feeding, such as Del Fabro Italian Pat. No. 832,780 are already known in the prior art. Bending and stirrup machines which bend in any shape bars, wire or the like either clockwise or counterclockwise have also been developed.

It has been particularly noticed that a well-known type of machine utilizes a bending method based on two bending pins. The bar that has to be bent is forced to pass through them, so that the bending is carried out either in a clockwise or in a counterclockwise direction, according to the rotation sense of the two fork pins. These pins alternate in order to become hinge elements in coincidence of their axis, thus determining the rotation axes above or under the bar which has to be bent.

A less interesting variant is represented by a machine that utilizes the same fork, but forces it to always rotate on only one of its two axes and therefore makes it pass over or under the bar for its clockwise or anti-clockwise bending.

Another type of machine which has been developed is provided with a fixed fork, around which a bending pin is made to partially rotate clockwise or counterclockwise, making it reenter and pass either above or under the bending bar. The expulsion of the finished product is caused by a pin which is coaxial to the rotation axis of said bending pin. In other cases, this pin acts not only as an expeller, but also as a shearing element. This last type of machine has the severe disadvantage of not being able to carry out a bending which is exactly 180° wide. Such a disadvantage is most likely caused by the fact that the shearing unit and the fixed guiding fork unit have to be necessarily placed near the bending unit.

Moreover, there are other secondary, but equally important disadvantages such that in order to maintain a real bending of 180°, it is necessary to turn the guiding unit and the shearing unit away from the bending area. This operation requires a larger amount of bar length and/or wire and the like for the beginning and the end of the stirrup, so causing the well-known defect that the bendings can't be sufficiently precise with respect to the suitable and/or wanted bending radius.

SUMMARY OF THE INVENTION

It is accordingly an object of the present invention to over come the disadvantages of the prior art as mentioned above.

Another object of the present invention is to produce a stirrup machine which can bend material in either a clockwise or counterclockwise direction.

A further object of the present invention is to produce a stirrup machine which utilizes a plurality of interchangeable central pins and only one spindle.

These and further objects are accomplished by developing a machine which utilizes a central fork guiding and sealing pin which is eccentric to allow the adjustment of the interchangeability in order to keep the bar, wire, metal strip, or the like constantly at a guiding altitude on the same bearing surface. This fork is also non-rotatable so as to avoid the dragging of the bar during the bending phase, retractile to facilitate the stirrup expulsion and to allow the shortening of the last hook before cutting and is extractive, and therefore interchangeable.

The bending unit or spindle of the present device is a disc rotating around the central pin. Although many different diameters of bars can be shaped with this apparatus, it was found that the present configuration was particularly suitable to bend bars having a diameter between 3 mm. and 14 mm. This unit has a bending nib which is adjustable allowing it to produce sides and hooks whose dimensions are reduced; the whole bending unit is mobile on the plane, and is transversal to the advancement of the bar and therefore it, like the central part, is also retractile. Furthermore, the machine before proceeding to the shearing of the finished stirrup, effects a recovery of the bar, so reducing to a minimum the waste of material.

This stirrup machine also exhibits the novel feature of bar recall and, consequently, of a stirrup recall after the stirrup has been already bent but has not yet been sheared. Additionally, this machine allows a movement of the central pin and of the bending nib-holder disc on the plane which is perpendicular to the bar feed, and since a plurality of central pins with a fork head for bending in both directions, with each fork head exhibiting a characteristic eccentricity with respect to a stem, avoids the registration of the whole operating unit. Furthermore, this machine has an adjustable means for the bending nib which is in the bending plane.

BRIEF DESCRIPTION OF THE DRAWING

The disclosure will be better explained with the aid of the following drawings in which are illustrated some essential parts of the machine and their working system in one of the preferred embodiments, as an example.

FIG. 2*a* is another embodiment of the operating unit of FIG. 2;

DETAILED DESCRIPTION OF THE PREFERRED EMBODIMENT

Figure 1:
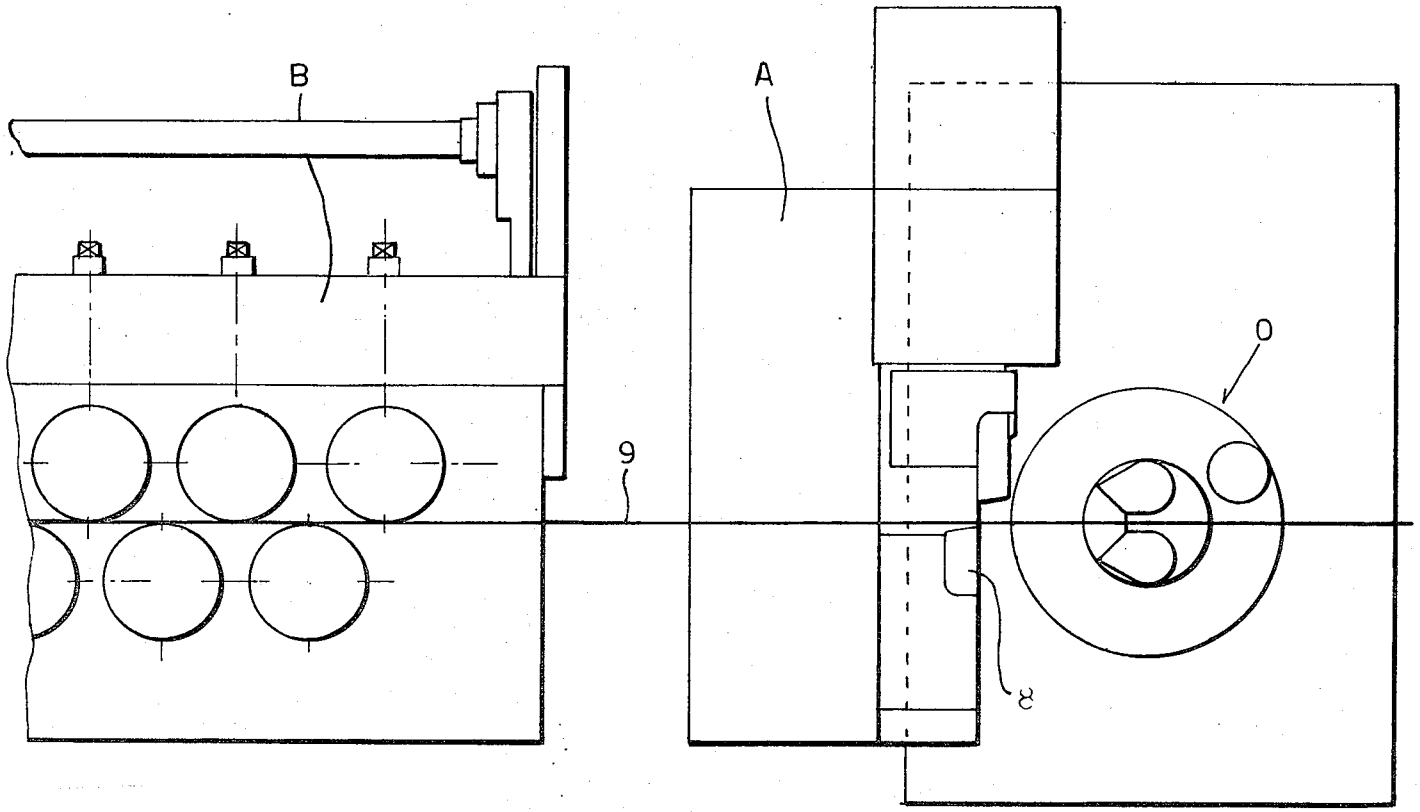
FIG. 1 is a schematic frontal view of the operating unit of the machine adjacent to the partially seen advancing and retracting unit.

According to FIGS. 1–4, the bending unit 0 of the machine is made of a support 1 which is bound to the machine base 2 at 3. This support is movable forward and backward by means of a fluid-dynamic cylinder 4 through the stem 5, which is hinged to said support 1 at 6. The cylinder 4 hinged to the machine base 2 at 7.

As mentioned previously, the operating bending unit 0 is mounted on the support 1 and just upstream from it the shearing unit 8 is placed, through which a bar 9, which has to be worked, is passed. The whole bending unit 0 is therefore sturdy due to the support 1 and moves on the plane which is perpendicular to the feed axis of the bar 9 following a curve trajectory whose curve is very slight since the support 1 is sufficiently long and the shifting is extremely reduced (just a few centimeters in the covered sector of a circle at the height of said operating unit).

Figure 4:
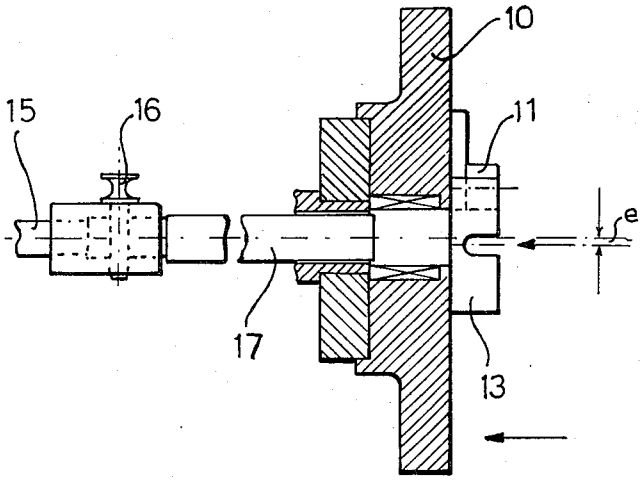
FIG. 4 is a sectional view of the apparatus of FIG. 3.
Figure 3:
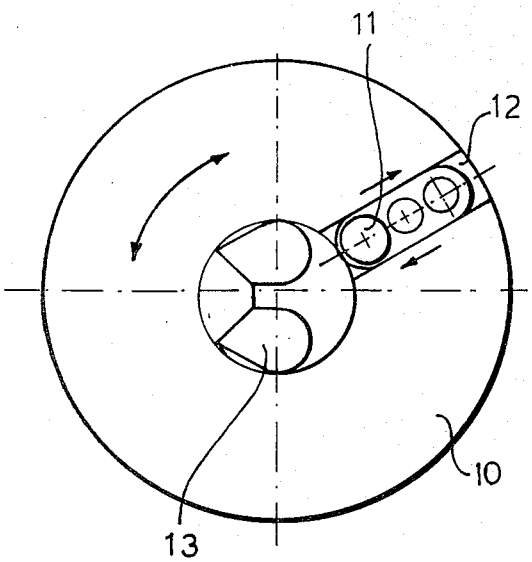

The operating unit is constituted by a disc 10 holding a nib 11 which is radially adjustable in a saddle 12 and is provided with a radial groove in said plate 10. A central guiding pin 13, which is retractable and non-rotatable, is placed in an axial arrangement with said disc 10. The retractability of this pin 13 is effected by means of the fluid-dynamic cylinder 14 which is bound to the support 1 and whose stem 15 is fixed to the stem 17 of the central fork pin 13 by means of a plug 16. The innovative characteristic of the movable, fork-shaped central pin 13 is that it is eccentric. This is to say that the joining stem 17 of form pin 13 is placed on an axis which is different from the axis of the fork pin 13. This eccentricity is shown in FIG. 4 and is denoted by *e*. The eccentricity is different for each type of interchangeable pin, since although the joining stem 17 would always be the same, the fork pin 13 can be different.

The fork 13 will have different diameters and different shapes according to the dimensions of the bar which has to be worked, and the eccentricity *e* derives from these variations in dimension so as to keep the fork 13 always aligned with the bar 9 for any diameter of the bar itself. It should be noted that when the diameter of the bar 9 varies, its axis would shift upward if the bar is larger, and it would shift downward if the bar is smaller, since the bar must always rest on the anvil of the shearing unit 8 to be efficaciously cut. The pin and stem configuration (13-17) is therefore moveable with respect to the bending disc 10, which rotates with respect to the pin 13 for the bending of the bar 9 either in one direction or the other. The clockwise or counterclockwise nozzle 11 for bending the bar 9 is effected by shifting the whole bending-operating unit (O and A) together with its support 1 and the central pin unit by means of the cylinder 4. Cylinder 14 is actuated at the same time and speed as the entire unit but the fork 13 remains in exactly the same position. This movement does not occur during the shearing phase of the operation.

Another substantial innovation of this machine is that it is provided with a recall (reversal) mechanism which can be utilized at the end of the stirrup preparation and before the shearing in order to reduce the dimensions of the final hook and to save material in each prepared stirrup. Moreover, it is possible to adjust the pin so that it can be drawn nearer or further with respect to the fork 13 because of either the diameter of the bar which has to be worked, or the kind of hooks to be obtained, or the quality of material employed.

Figure 5:
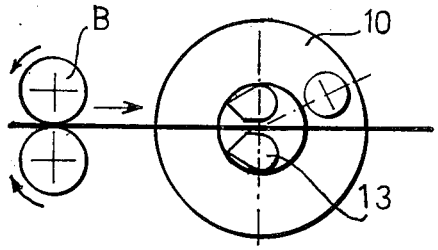
FIGS. 5 to 24 are a series of exemplifying operative phases which illustrate the operating system of said unit (and, consequently, of the stirrup machine).
Figure 6:
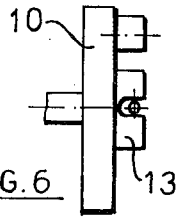

Referring to one of the possible methods for preparing stirrups, the operating unit works as follows:

1. The feeder-retractor B causes the bar of a wanted extent to proceed forward as in a conventional manner such as with an electronic system of counter-pulses. This would allow the bar to pass through the fork 13 (FIGS. 5–6).

Figure 7:
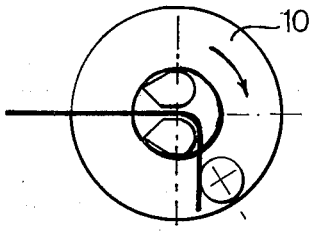
Figure 8:
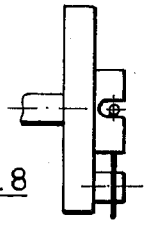

2. The bending disc 10, which has been already placed in position will initiate a first bending of the bar — for instance, in a clockwise direction in a conventional manner as shown in the above-mentioned Del Fabro patent or in any other suitable way (FIGS. 7–8).

Figure 9:
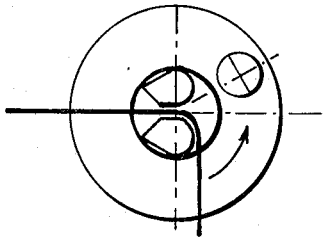
Figure 10:
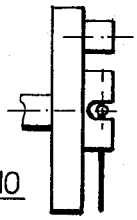
Figure 11:
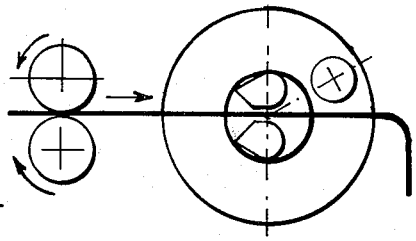
Figure 12:
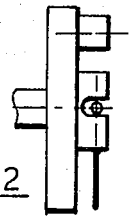

3. Afterwards, the disc 10 returns to its original position (FIGS. 9–10), while a predetermined length of a bar feed is moved through the machine (FIGS. 11–12).

Figure 13:
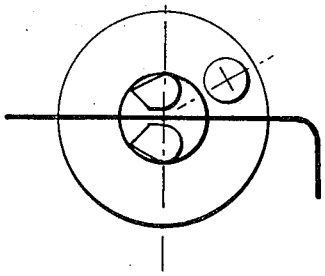
Figure 14:
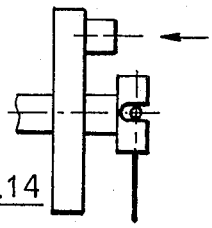
Figure 15:
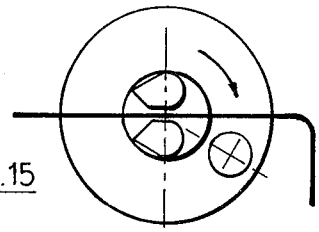
Figure 16:
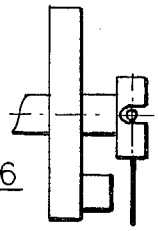
Figure 17:
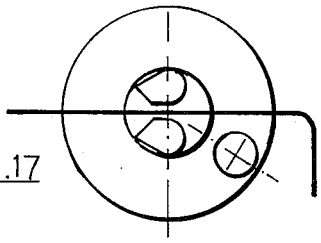
Figure 18:
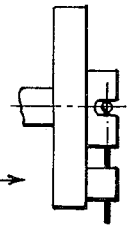
Figure 19:
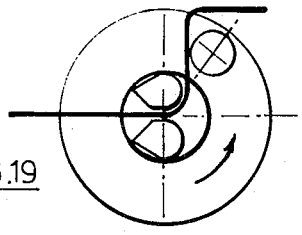
Figure 20:
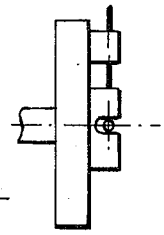

4. The operating unit then shifts backward to change the bending sense, while the fork 13 is pushed forward, but is kept in the same position of bar release by putting in action the two opposite cylinders 4 and 14 (FIGS. 13–14); then the operating unit goes to the opposite side with respect to the bar by means of a rotation (FIGS. 15–16), coming successively to the normal position again (FIGS. 17–18) and carrying out another bending which is counterclockwise (FIGS. 19–20).

Figure 21:
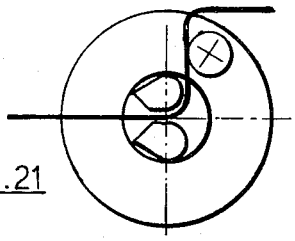
Figure 22:
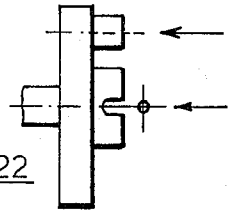

5. The construction of the stirrup being finished, the whole operating unit comes back, while only cylinder 4 starts functioning (FIGS. 21–22).

Figure 23:
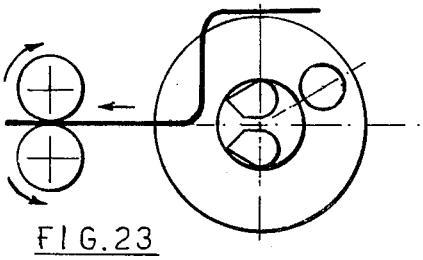

6. The bar 9 is compelled to withdraw together with the respective stirrup which has already acquired a definite shape (FIG. 23).

Figure 24:
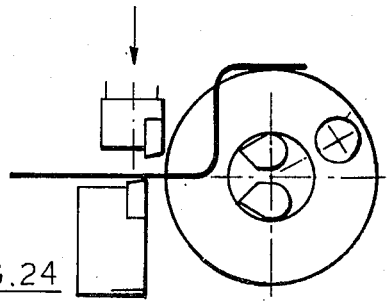

8. The stirrup is cut out from the bar 9 at the desired point (FIG. 24).

Figure 2:
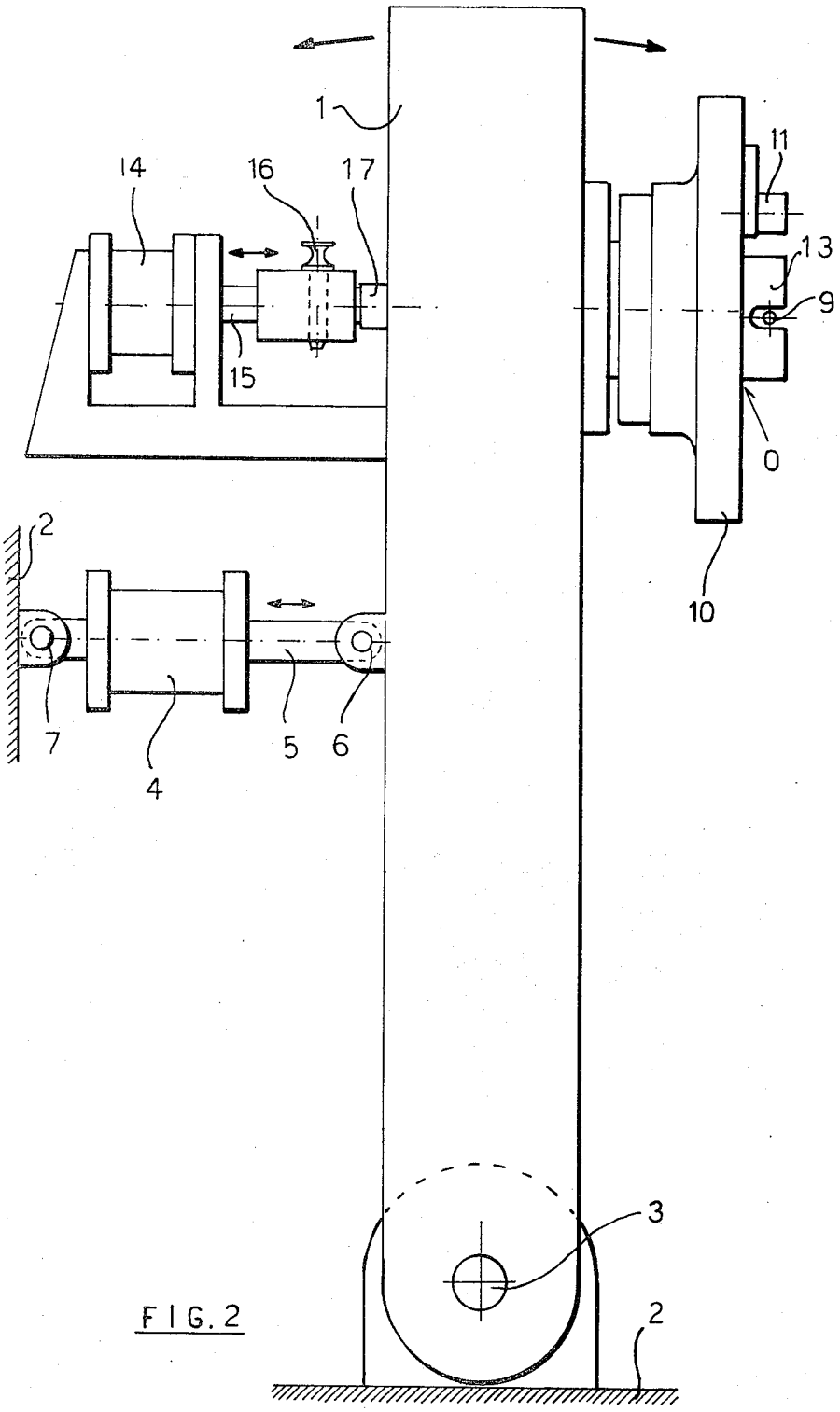
FIG. 2 is a schematic view of the operating unit of FIG. 1 without a visualization of the rotating gears of the bending disc.
Figure 3:
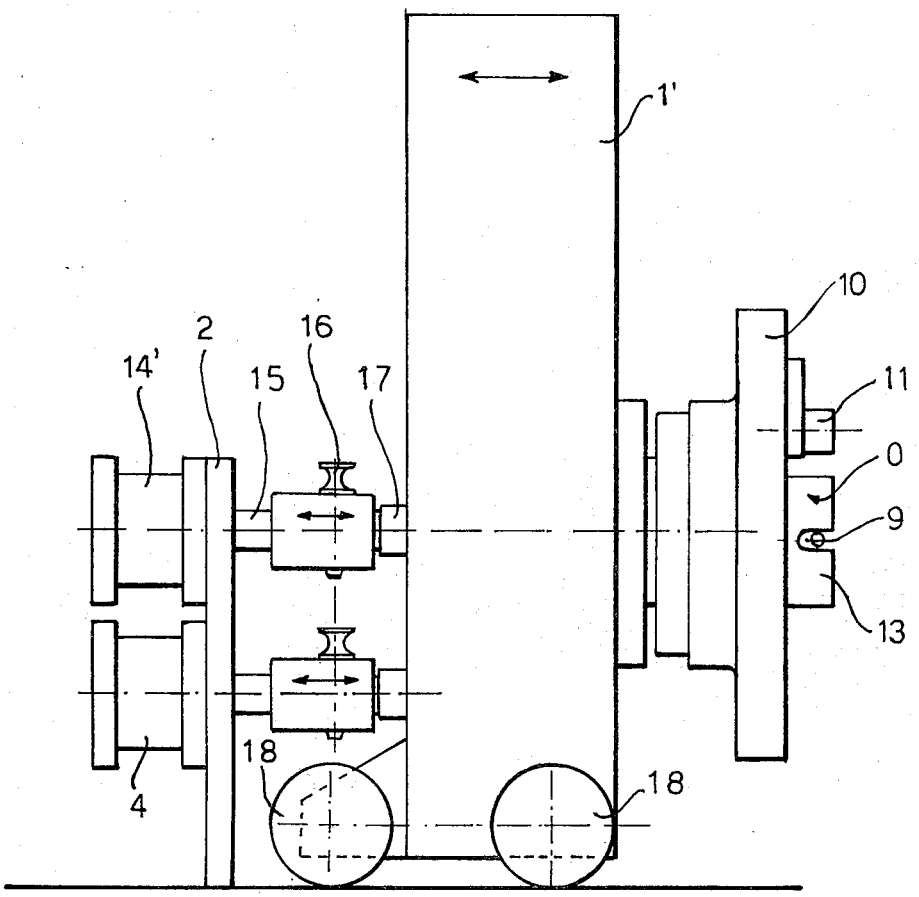
FIG. 3 is a front view of the central bending unit of the operating unit.

FIG. 2*a* shows an interesting variant to the operating method of the unit illustrated in FIG. 2. In this embodiment it should be noted that either the cylinder 4 or the cylinder 14 (that is changed to 14′ in this case) of FIG. 2 is anchored to the machine base and the support 1 (now 1′) is mounted on a truck provided with wheels and/or guiding rolls 18 that slide on a sliding surface of the machine "chassis". Therefore, in this configuration, when the bending invention is to be effected, only the cylinder 4 will work, while support 1 and its bending unit will be withdrawn. Furthermore, when the stirrup shearing is to be performed, namely, before its recall (reversal), both the cylinders 4 and 14′ will start working, so determining the contemporary return either of the support 1′ and its respective bending disc or the central fork pin. The operative results, in this configuration will be the same as the ones which have been described above.

Obviously, the invention is not limited to the abovedescribed and illustrated embodiments; on the contrary, they can be considered as the base of other forms and ways of realization whose executing details may vary without exceeding the essence of the stated and herein described disclosure.

It will be obvious to those skilled in the art that various changes may be made without departing from the scope of the invention and the invention is not to be considered to be limited to what is shown in the drawings and described in the specification.

What is claimed is:

1. A stirrup machine for bending of stock material such as bars, wires, metal strips or the like and forming individual, bent pieces therefrom, the machine comprising:

advancing and reversing means for selectively advancing feed of the stock material which is to be bent and reversing feed of the stock material which has been bent;

support means for supporting the stock material to be bent;

first operating means connected to said support means for enabling said support means to be moved forward or backward with respect to the stock material;

bending means mounted on said support means for bending the stock material, said bending means being connected to said first operating means and being movable with said support means; and shearing means mounted between said advancing and reversing means and said bending means for shearing the stock material at a desired location subsequent to bending and reversal thereof.

2. A stirrup machine according to claim 1, wherein said bending means includes an interchangeable central pin having dimensions according to given stock material to be bent, and second operating means which includes a stem of constant shape and dimensions, said stem being attached to said interchangeable central pin to move said pin relative to other parts of said bending means, the axis of said pin and the axis of said stem being parallel and eccentric, and wherein the diameter or the thickness of the stock material to be bent can vary and alignment of the stock material to be bent with said shearing means is assured.

3. Stirrup machine according to claim 1, wherein said bending means includes a retractible and non-rotating central pin, and a retractible disc having a rotating bending nib attached thereto, said central pin and said retractible disc being selectively concurrently movable and separately movable in the plane perpendicular to the axis of the stock material to be bent.

4. Stirrup machine according to claim 3 further including a second operating means for enabling said support means to be forwardly or backwardly connected to said support, both said first and said second operating means including respective fluid-dynamic cylinders, said first operating means effecting singly movement of said central pin and said retractible disc in their movement in a plane perpendicular to the axis of the stock material, and said first and said second operating means acting together substantially effecting a net movement to said pin of zero, one of said fluid-dynamic cylinders imparting the same speed to said central pin as the speed in the same axis as is imparted thereto by the other of said fluid-dynamic cylinders in an opposite direction.

5. A method for bending stock material such as bars, wires, metal strips or the like and forming individual, bent pieces therefrom in a stirrup machine comprising the steps of:

advancing the stock material to be bent past a severing station into a bending station in said stirrup machine;

bending said stock material into the desired shape in the bending station;

reversing the feed of the stock material thereby removing a portion of the already fed stock material from said bending station of the stirrup machine subsequent to bending therein; and subsequently shearing the stock material in the severing station close to a bend therein thereby reducing to a minimum the waste of stock material.

* * * * *

REEXAMINATION CERTIFICATE (177th)

United States Patent [19] [11] B1 3,991,600

Del Fabro [45] Certificate Issued Mar. 20, 1984

[54] STIRRUP MACHINE

[76] Inventor: Remigio Del Fabro, Villaggio Morena n. 62, Reana Del Roiale, Udine, Italy, 33010

Reexamination Request:
No. 90/000,331, Feb. 17, 1983

Reexamination Certificate for:

| | |
|---|---|
| Patent No.: | **3,991,600** |
| Issued: | **Nov. 16, 1976** |
| Appl. No.: | **597,372** |
| Filed: | **Jul. 18, 1975** |

[30] Foreign Application Priority Data

Nov. 15, 1974 [IT] Italy ..... 83429/74

[51] Int. Cl.[3] ..... B21D 7/02; B21D 7/08

[52] U.S. Cl. ..... 72/203; 72/217

[58] Field of Search ..... 72/129, 131, 132, 149, 72/166, 203, 216, 217, 219, 294, 380; 140/102, 104, 105

[56] References Cited

U.S. PATENT DOCUMENTS 3,823,749 7/1974 Ritter et al. ..... 140/105

FOREIGN PATENT DOCUMENTS 1552932 1/1970 Fed. Rep. of Germany .
971194 4/1974 Italy .

*Primary Examiner*—E. Michael Combs

[57] ABSTRACT

A method and apparatus for bending bars, wires, metal strips or the like has been developed. The apparatus consists of a feeding device which feeds the material to be formed to a central fork pin which holds the material. A rotating disc is provided with a nib for bending the material. After the material is bent, the feed of the material is reversed so as to ensure that the material will be sheared close to the bend, thereby reducing waste.

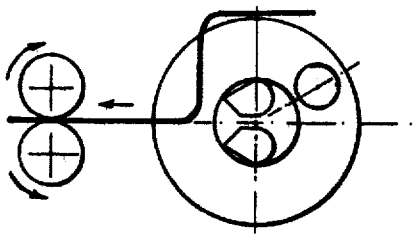

REEXAMINATION CERTIFICATE ISSUED UNDER 35 U.S.C. 307.

THE PATENT IS HEREBY AMENDED AS INDICATED BELOW.

Matter enclosed in heavy brackets [ ] appeared in the patent, but has been deleted and is no longer a part of the patent; matter printed in italics indicates additions made to the patent.

AS A RESULT OF REEXAMINATION, IT HAS BEEN DETERMINED THAT:

The patentability of claim 5 is confirmed.

Claim 1 is determined to be patentable as amended:

Claims 2–4, dependent on amended claims, are determined to be patentable.

New claims 6–9 are added and determined to be patentable.

1. A stirrup machine for bending of stock material such as bars, wires, metal strips or the like and forming individual, bent pieces therefrom, the machine comprising:

advancing and reversing means for selectively advancing feed of the stock material which is to be bent and reversing feed of the stock material which has been bent;

support means for supporting the stock material to be bent;

first operating means connected to said support means for enabling said support means to be moved forward or backward with respect to the stock material;

bending means mounted on said support means for bending the stock material, said bending means being connected to said first operating means and being movable with said support means; and shearing means mounted between said advancing and reversing means and said bending means for shearing the stock material at a desired location subsequent to bending and reversal thereof, *whereby after said stock material has been bent, said advancing and reversing means can be actuated to reverse the stock material to a position adjacent said shearing means, so that upon actuation of said shearing means, the bent piece is cut from the stock material close to the bend, thereby reducing stock material waste.*

*6. A stirrup machine for bending of stock material such as bars, wires, metal strips or the like and forming individual, bent pieces therefrom, the machine comprising:*

*advancing and reversing means for selectively advancing feed of the stock material which is to be bent and reversing feed of the stock material which has been bent;*

*non-rotatable and axially movable support means for supporting the stock material to be bent within a bending plane;*

*axially shiftable and rotatable bending means mounted coaxially on and movable independent of said support means, said bending means being for bending the stock material, said bending means being movable out of the bending plane with said support means and being movable relatively to said support means;*

*shearing means mounted between said advancing and reversing means and said bending means for shearing the stock material at a desired location subsequent to bending and reversal thereof;*

*first operating means connected to said support means and said bending means for enabling said support means and bending means to be moved forward into the bending plane, and backward out of the bending plane prior to reversing feed of the stock material and shearing; and*

*reverse controlling means for, after said stock material has been bent, actuating said advancing and reversing means to reverse the stock material to a position adjacent said shearing means, so that upon actuation of said shearing means, the bent piece is cut from the stock material close to the bend, thereby reducing stock material waste.*

*7. A stirrup bending machine according to claim 6, wherein said support means includes an interchangeable central pin provided at its end with a fork and having dimensions selected according to the given stock material to be bent, said bending means including a stem of constant shape and dimensions projecting from an annular member rotatably surrounding said central pin of said support means, the axis of said stem being parallel to and spaced from the axis of said central pin, said stirrup machine further including second operating means connected to said stem for enabling said bending means to be shifted axially forward or backward with respect to the stock material independent of said support means.*

*8. A stirrup machine according to claim 6, comprising second operating means to axially move said bending means backward out of the bending plane independently of said support means.*

*9. A method for bending stock materials such as bars, wires, metal strips or the like and forming individual, bent pieces therefrom in a stirrup machine, comprising the steps of:*

*advancing the stock material to be bent past a severing station into a bending station in said stirrup machine;*

*bending said stock material in a bending plane into the desired shape in the bending station, using a rotatable bending means, while supporting said stock material with a support means;*

*retracting said bending means and said support means axially out of the bending plane to enable the bent stock material to be reversed past the location of said support means;*

*reversing the feed of the stock material thereby removing a portion of the already bent stock material from said bending station of the stirrup machine to a shearing station upstream of said bending station; and*

*subsequently shearing the stock material in the shearing station close to a bend thereof to thereby reduce to a minimum the waste of the stock material.*

* * * * *